US005417775A

United States Patent [19]

Pedrazzini

[11] Patent Number: 5,417,775

[45] Date of Patent: May 23, 1995

[54] PROCESS FOR CONTINUOUS TITANIUM SHEET PICKLING AND PASSIVATION WITHOUT USING NITRIC ACID

[75] Inventor: Cesare Pedrazzini, Milan, Italy

[73] Assignee: ITB S.r.l., Milan, Italy

[21] Appl. No.: 126,528

[22] Filed: Sep. 24, 1993

[30] Foreign Application Priority Data

Oct. 12, 1992 [IT] Italy ..... MI92A0234

[51] Int. Cl.[6] ..... C23C 22/34

[52] U.S. Cl. ..... 148/269; 148/270; 148/273; 148/274; 148/281

[58] Field of Search ..... 148/269, 270, 273, 274, 148/281, 269, 270, 273, 274, 281

[56] References Cited

FOREIGN PATENT DOCUMENTS 60-243289 12/1985 Japan .

*Primary Examiner*—Scott Kastler
*Assistant Examiner*—Robert R. Koehler
*Attorney, Agent, or Firm*—Hedman, Gibson & Costigan

[57] ABSTRACT

Process for sheet titanium pickling followed by passivation. Pickling is carried out in an aqueous solution containing $H_2SO_4$, HF and $Fe^{3+}$ at $\leqq 50°$ C., continuously fed with an air flow, and with a stabilized $H_2O_2$ quantity adjusted to the bath redox potential to be kept at −200 to 0 mV. Passivation is carried out in an aqueous bath containing 4 to 10 g/l HF, $\leqq 1$ g/l $Fe^{3+}$, and not containing $H_2SO_4$, with a redox potential kept at 500–600 mV by continuous feeding of stabilized $H_2O_2$.

3 Claims, No Drawings

PROCESS FOR CONTINUOUS TITANIUM SHEET PICKLING AND PASSIVATION WITHOUT USING NITRIC ACID

TECHNICAL FEATURE

As is known when, during the manufacturing process, iron and steel industry products undergo hot-rolling of intermediates undergo heat treatment, such as for instance annealing, the material is coated with a thinner of thicker oxidation layer. In consideration of the final products having to exhibit a polished and glossy finish, the oxidation layer is to be removed entirely. This is done through the well-known pickling process generally using mineral inorganic acids, such as hydrochloric acid, sulphuric acid, nitric acid, and hydrofluoric acid, either individually of as mixtures.

According to the industrial processes currently applied, titanium pickling is normally, of almost exclusively, based on the use of a nitric-hydrofluoric acid mixture, i.e. a bath similar to that used for stainless steel. It follows that the same plants and apparatus as used for stainless steel treatment can be employed. Although the process is undoubtedly economic and leads to excellent results, it involves extremely serious ecological problems hard to solve, brought about by the use of nitric acid. Actually, while on the one hand highly polluting nitrogen oxide vapours having general formula $NO_x$, aggressive toward metallic and non-metallic materials with which they come into contact, are vented to the atmosphere, on the other hand high nitrate concentrations are reached in wash water and spent baths, both types of pollutants requiring treatment prior to disposal. The removal of $NO_x$ from air and of nitrates from baths involves huge plant operation problems and high operating costs, with no certainty about the obtainment of targets complying with the regulations in force. This means that the resulting industrial plant investment costs can be hardly borne in most cases.

A pickling method not requiring the use of nitric acid is therefore demanded by industry and various proposals in this sense have been made in these last ten years.

DESCRIPTION OF THE INVENTION

The process consists in a pickling step followed by passivation and can be applied to commercially pure titanium semimanufactured products having undergone hot- or cold-rolling and heat treatment, e.g. annealing, if any.

The process was particularly developed for application to strips.

The process is based on the use of a pickling bath containing iron ions, $H_2SO_4$, HF, $H_2O_2$ and a maximum of 1 g/l of conventional additives—such as wetting agents, emulsifiers, polishing agents, inhibitors—continuously blown into with a strong air flow, equal to 3 m3/h per m3 bath min. The operating temperature must not exceed 50° C., and should preferably range from 35° C. to 40° C.: bath cooling is required, the process being highly exothermic. The starting bath consists of an aqueous solution containing:

| | |
|---|---|
| HF | 10 to 30 g/l |
| $H_2SO_4$ | 20 to 50 g/l |
| $Fe^{3+}$ | ≧15 g/l. |

Once the treatment has started, the bath redox potential tends to fall below 0 mV while the $Fe^{3+}$ content in the bath decreases. Optimal operating conditions are restored by keeping the redox potential between −200 to 0 mV, which is secured by a combined action due to the air continuously blown into the bath—which produces bath agitation—as well as to hydrogen dioxide added either continuously or periodically to the bath. In the course of treatment, proper free acidity values are maintained by periodically feeding HF and $H_2SO_4$: in particular, pH must be kept at ≦1.5.

Passivation is carried out at room temperature in a bath consisting of an aqueous solution containing a low amount of HF (10 g/l max.) and not containing $H_2SO_4$ and iron ions. The redox potential is kept at high values (between 500 and 600 mV) by continously feeding low amounts of $H_2O_2$.

Bath agitation is secured by a continous air flow.

Continuous addition or stabilized hydrogen peroxide during pickling and passivation phases.

Needless to say that to secure process economics it is necessary to use as little hydrogen peroxide as possible. This is why it is very important to use hydrogen peroxide containing a known stabilizer capable of preventing, or at least of reducing significantly, the peroxide decomposition process under the following conditions: temperature up to 50° C., strongly acid bath pH, presence of iron ions in the pickling bath, presence of free or complex Ti ions. Stabilizers for $H_2O_2$ effective in acid medium are for instance: 8-hydroxyquinoline, sodium stannate, phosphoric acids, salycylic acid, pyridincarboxylic acid. As a particularly suitable stabilizer came out phenacetin (i.e. acetyl-p-phenetidine) used in amount corresponding to 5+20 ppm to the pickling bath.

A suitable stabilizer is the one sold by Interox (Solvay) under the trade name Interox S 333 or Interox S 333C, removable from spent solutions by the traditional chemo-physical methods and not containing any pollutant.

The use of duly stabilized $H_2O_2$, combined with the use of air blown into the bath, has made it possible to develop a process based on the use of $H_2O_2$, which has resulted to be economic, an advantage that no known process has ever been capable of offering. The pickling bath is prepared with a starting $H_2O_2$ quantity (as 130 vol. commercial product) ranging from 1 to 20 g/l, preferably from 2 to 5 g/l.

As already mentioned, the addition of $H_2O_2$ during the process cycle is substantially adjusted to the pre-set oxidation potential of the bath, both of pickling and of passivation.

EXAMPLE

Hot-rolled strip titanium was treated in a pickling bath having the following starting composition:

| | | |
|---|---|---|
| $H_2SO_4$ | | 20 to 50 g/l |
| $Fe^{3+}$ | | 40 to 60 g/l |
| $F^-$ | (from free HF) | 10 to 20 g/l |

During operation, the bath temperature was kept at 35° to 50° C. by cooling the solution.

The redox potential was kept at −200 to 0 mV by feeding $H_2O_2$ stabilized with Interox S 333.

Bath agitation was secured by an air flow equal to 3 m3/h per m3 bath.

The treated material, after a 90-sec. residence in the bath, was fed to the passivation bath consisting of an aqueous solution containing 4 to 10 g/l free HF, 1 g/l $Fe^{3+}$ max., and practically not containing free $H_2SO_4$.

The bath temperature was room temperature, the redox potential was kept at 500 to 600 mV by continous $H_2O_2$ feeding. Bath agitation was secured by a strong air flow.

The material surface was perfectly clean, polished, and free from corrosion phenomenon.

I claim:

1. Process for the pickling of titanium manufactured articles or intermediates produced by procedures including heat treatment, followed by passivation of the pickled material, consisting in the operation of: placing the material to be treated in a pickling bath kept at a maximum temperature of 50° C., said pickling bath comprising the following initial composition:

a) $H_2SO_4$ 20 to 50 g/l b) $Fe^{+3}$ at least 15 g/l c) HF 10 to 30 g/l d) stabilized $H_2O_2$ 1 to 20 g/l e) a maximum of 1 g/l of additives selected from the group consisting of emulsifiers, wetting agents and polishing agents, said bath being fed continuously with a minimum air flow of 3 cubic meters per hour per cubic meter of bath volume through a air feed which distributes the flow in the liquid mass of the bath;

maintaining the concentration of $H_2O_2$ at a quantity to provide a bath redox potential of −200 to 0 mV, and if necessary adding sufficient amounts of $H_2SO_4$ and HF to provide a bath pH not higher than 1.5; and thereafter placing the material to be treated in a passivation bath consisting of an aqueous solution containing 4 to 10 g/l of free HF, a maximum of 1 g/l $Fe^{+3}$ said bath being substantially free of $H_2SO_4$ and being continuously fed with a sufficient amount of stabilized $H_2O_2$ to adjust the bath redox potential to 500 to 600 mV, said passivation bath being maintained at room temperature with a sufficient air flow to agitate the liquid in said passivation bath.

2. Process according to claim 1 wherein the temperature of the pickling bath is maintained between 35° and 40° C.

3. Process according to claim 1 wherein the concentration of the $H_2O_2$ in the starting composition of the pickling bath is from 2 to 5 g/l.

* * * * *